United States Patent [19]

Ishizuka et al.

[11] Patent Number: 4,875,873

[45] Date of Patent: Oct. 24, 1989

[54] MULTI-TERMINAL CONNECTOR

[75] Inventors: Shigeo Ishizuka; Katsutoshi Kuzuno, both of Shizuoka, Japan

[73] Assignee: Yazaki Corporation, Tokyo, Japan

[21] Appl. No.: 280,805

[22] Filed: Dec. 7, 1988

[30] Foreign Application Priority Data

Dec. 9, 1987 [JP] Japan ..... 62-309386

[51] Int. Cl.[4] ..... H01R 4/50

[52] U.S. Cl. ..... 439/347; 439/372; 439/376; 439/157

[58] Field of Search ..... 439/152, 153, 157, 159, 439/310, 330, 331, 247, 259–262, 372, 376, 670, 266, 269, 347

[56] References Cited

U.S. PATENT DOCUMENTS

| | | | |
|---|---|---|---|
| 3,392,245 | 7/1968 | Asick | 439/347 |
| 4,332,432 | 6/1982 | Colleran | 439/157 |
| 4,586,771 | 5/1986 | Kraemer et al. | 339/75 |
| 4,648,668 | 3/1987 | Sinisi | 439/260 |
| 4,684,194 | 8/1987 | Jenkins et al. | 439/260 |

FOREIGN PATENT DOCUMENTS

| | | | |
|---|---|---|---|
| 2424643 | 12/1979 | France | 439/152 |

*Primary Examiner*—David Pirlot
*Attorney, Agent, or Firm*—Armstrong, Nikaido, Marmelstein, Kubovcik & Murray

[57] ABSTRACT

A connector including a female housing having a plurality of male terminals and a male housing having a plurality of female terminals. The female housing further includes at least two guide rails connected to each other and provided with an axis hole. A pair of sliders are each slidably engageable with the guide rails. Each slider has an upwardly projecting pin and a cam follower projecting downwardly. A pair of longitudinally aligned slots are formed between the two guide rails and receive the cam followers. A pair of cam tracks arranged in an outer surface of the male housing engage the cam followers which extend through the slots. A rotary actuator plate having two symmetrical grooves provided around a downwardly projecting pin is attached to the rail connecting portion by inserting the pin in the axis hole. The upwardly projecting pins are received in the grooves of the actuator plate which can be rotated with a relatively small force to engage and disengage the housings and the terminals provided therein.

8 Claims, 6 Drawing Sheets

MULTI-TERMINAL CONNECTOR

BACKGROUND OF THE INVENTION

1. Field of the Invention

The present invention relates to a multi-terminal connector composed of a male housing and female housing provided with a plurality of female terminals and male terminals respectively therein to be connected to or disconnected from each other by a considerably small force owing to a cam mechanism adopted therein.

A such hither-to-known multi-terminal connector which requires a minimum force as disclosed in the U.S. Pat. No. 4,586,771 comprises a first housing containing two aligned slots, a second housing containing a cam track, and a slider provided with a cam follower for moving along the cam arranged on the first housing.

The above slider is formed in an U shape composed of a web and a pair of arms extending therefrom in parallel, the length of both arms being equal to the distance between the edge walls of the flange forming a hood in the first housing for accomodating the second housing, wherein the cam follower projects inside the arm.

Consequently, for engaging the first housing with the second one by utilization of the above slider, it must be inserted at right angles to its engaging direction, that is, inserted from a side of the connector, thus the space for the installation thereof cannot securely be obtained in a limited space such as inside the instrument panel of a car and its operability is not sufficiently high.

In order to solve the aformentioned problem, an applicant for patent has constructed a pair of guide rails at the upper portion of the covering body of the male housing for accommodating the female housing so as to provide a low force requiring multi-terminal connector of the structure in which a pair of sliders with respective cam followers are slidably premounted as shown by Japanese Patent Application No. 62-219018.

In the above case, the male housing provided with the cam track is accessed to the female housing by drawing both of the sliders towards each other using a thumb and other fingers of one hand, whereby the engaging operation can be easily performed even in a narrow space. The reverse operation may be accomplished in a similar but reverse manner. That is, separation of the two housings engaged with each other by the above operation, can be done by shifting movement of the both sliders in a reverse direction, but it is extremely difficult to pursue in a limited space, as this operation requires using two hands.

SUMMARY OF THE INVENTION

A low force requiring multi-terminal connector according to the present invention provides an easy separation of the above housings engaged with each other even in a narrow space, and also with a considerably small force.

The above objects, features and advantages of the present invention will become apparent from the following description disclosed in conjunction with the accompanying drawings.

FIG. 1 shows a low force requiring multi-terminal connector according to the present invention which includes a female housing 1 that stores a plurality of male terminals and, a male housing 9 that stores a plurality of female terminals. The female housing includes a pair of guide rails 4, 4' and also a reverse trapozodial supporting rail 6 therebetween, 4 and 6 of which are connected to each other at the center portions thereof and provided with an axis hole 7 on the longer side edge wall 3a of an enlarged body 3 arranged in the female housing 1 for accommodating the male housing 9. The guide rails intersect at right angles to the axis of the terminals. A pair of sliders 15 have inserting grooves 17 and 17', each slidably engageable with the guide rails and a pin upwardly projected from the top surface thereof and a cam follower 19 downwardly projecting from the lower end portion thereof. A pair of longitudinally aligned slots 5 are formed between the rails 4 and 6 at the top end portion of the enlarged body 3 for permitting each of the cam followers to extend therethrough. A pair of cam tracks 13 and 13' for engaging with the cam followers 19 penetrating through the respective slots 5, are arranged on the edge wall 12 of the male housing 9 with each one having an entrance 13*a* extending backwardly from the lateral ends of a surface 10*a* which is disposed for engaging with the female housing 1. By the above structure, male housing 9*c* an be engaged with or separated from the female housing 1 by shifting operation of the pair of sliders 15 along the guide rails 4 and 4'.

DETAILED DESCRIPTION OF THE EMBODIMENTS

Figure 1:
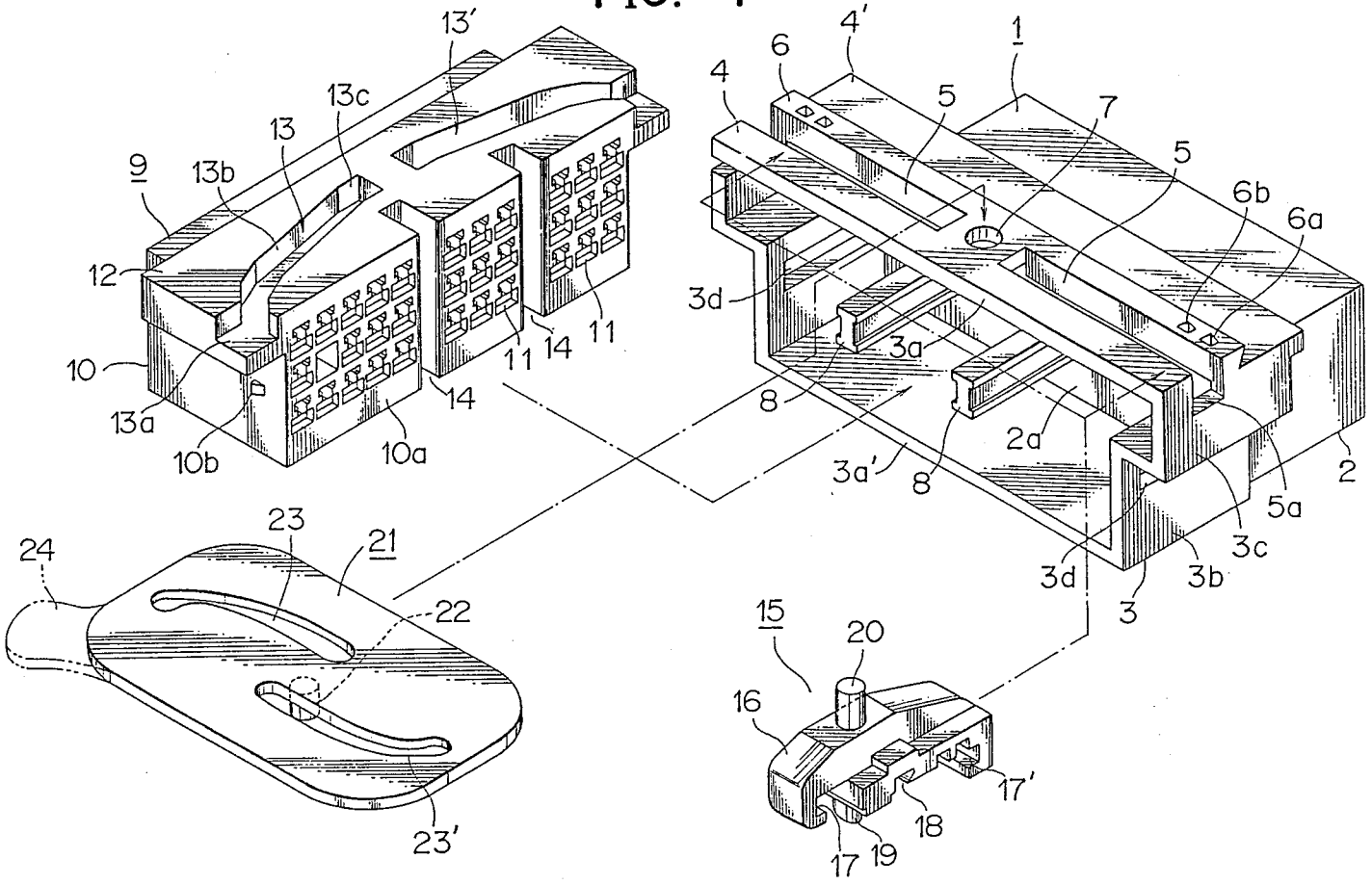
FIG. 1 is a perspective view showing one embodiment of the connector according to the present invention.

The above-explained low force requiring multi-terminal connector according to the present invention is characterized in that a pin 20 is mounted at the upper surface of the pair of sliders 15, and at the same time a rotary actuator plate 21 is removably and rotatably mounted on the enlarged body 3, and the above pins 20 being inserted to the pin guide grooves 23 and 23' arranged in the above rotary actuator plate, whereby the above sliders 15 can be shifted by the normal and reverse rotation of the rotary actuator plate 21.

In the above structure, the female housing 1 contains the enlarged body 3 for accomodating the male terminals 1*a* at the front part of the main body 2 thereof. The enlarged body 3 is a frame having side walls 3*a* and 3*a'* vertically facing to each other and edge walls 3*b* horizontally facing to each other, the upper portions of the respective edge walls 3*b* forming outwardly expanding portions 3c therefrom to be connected to each end of the upper side walls 3*a*.

At the upper side wall 3*a*, the guide rails 4 and 4' are arranged at different levels respectively along the front and rear side thereof, and two longitudinally aligned slots 5 with respective entrances 5*a* thereof are also arranged. 6 denotes a reverse trapozodial supporting rail arranged for preventing the slider 15 from slipping off the side wall 3a by the engaging resistance between the both male and female housings when the slider 15 is activated to slide. Numeral 7 denotes an axis hole for enabling the rotary actuator plate 21 to be removably supported.

In the male housing 9, an expanded portion 12 (side wall) for engaging with the expanded portion 3c of the enlarged body 3 is disposed on the upper portion of the main body 10 having a plurality of storing cells 11 therein for accomodating a plurality of female terminals 9a and a pair of cam tracks 13 and 13' are further arranged on the above expanded portion 12. The cam tracks 13 and 13' respectively form the entrance 13a extending towards inside from the both edges of the surface 10a which is arranged for engaging with the female housing 1, the middle portion 13b extending diagonally backwards, and of the end portion 13c which runs in parallel with the above engaging surface 10a. The both end portions 13c can be connected to each other, although they are disposed as being separated in FIG. 1.

The slider 15 comprises inserting grooves 17 and 17' at both ends of a lower surface of the beam-like main body 16, but at different levels for engaging with the guide rails 4 and 4', a supporting groove 18 in the middle portion of the lower surface of the main body for engaging with the supporting rail 6 which is arranged on the female housing 1, a cylindrical cam follower 19 downwardly projecting between the supporting groove 18 and the inserting groove 17, and also a pin 20 projecting from the upper surface of the main body.

A rotary actuator plate 21 comprises a downwardly projecting axis 22 supported by the above axis hole 7 in the center portion thereof, a pair of involutedly arcuated pin guide grooves 23 and 23' symmetrically arranged around the axis hole 7 so as to be engaged with the above pin 20, and also a projected handle 24 protruding from a corner of the plate 21 itself.

By the way, since both male and female housings 9 and 1 are largely formed in size as a multi-terminal connector, as shown in FIG. 1 it is preferable to construct a plurality of engaging guide shafts 8 in the engaging surface 2a of the female housing 1, and also to construct corresponding female portions 14 in the engaging surface 10a of the housing 9 for engaging with the above guide shafts 8, so that the possible ricketiness upon engaging the both housings can be prevented together with the effect of the reverse engagement between the rail 6 and the groove 18 mentioned above. 3d and 10b are a locking hole and a locking nail forming a locking means together. It is also preferable to construct a pair of catching nails 6a and 6b at both ends of the upper surface of the supporting rail 6, and also a catching projection 18a to be engaged between the above catching nails 6a and 6b at the bottom surface of the supporting groove 18 of the slider 15.

The function of engaging and separating means between the both housing 1 and 9 are explained below referring to FIG. 2 to FIG. 4.

Figure 2:
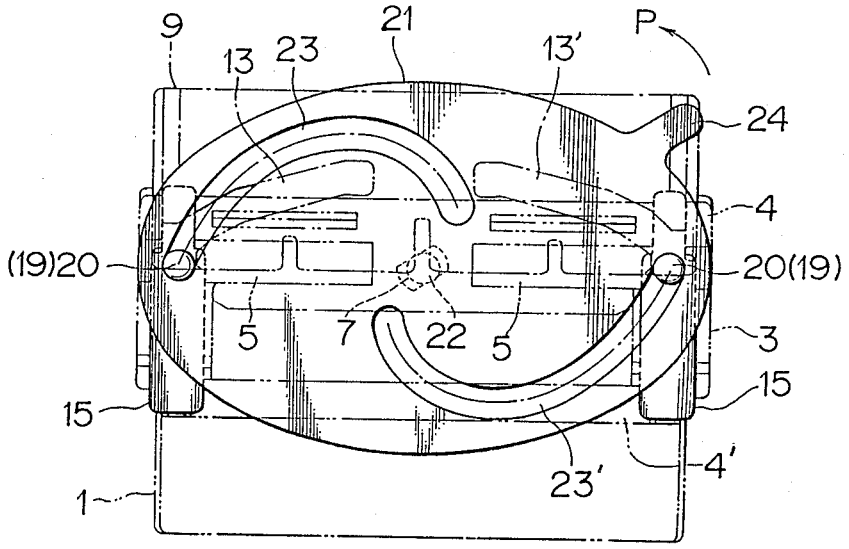
FIG. 2 to FIG. 4 are plan views respectively describing the operating states of the connector shown in FIG. 1

First of all, shift a pair of sliders 15 premounted on the enlarged body 3 of the female housing 1 respectively to the end portions of the guide rails 4 and 4' (open location ) as shown in FIG. 2. In this situation, if the sliders 15 are locked by the before-mentioned catching nails 6a and 6b, the shifting operation to the above location is not necessary.

In the above state, insert each of the cam followers 19 of the respective sliders 15 into the cam tracks 13, 13' until it strikes the inner wall of the respective entrance 13a thereof. Then, insert the axis 22 of the rotary actuator plate 21 into the axis hole 7, and engage each of the pins 20 of the respective sliders 15 with the pin guide grooves 23, 23'.

Figure 3:
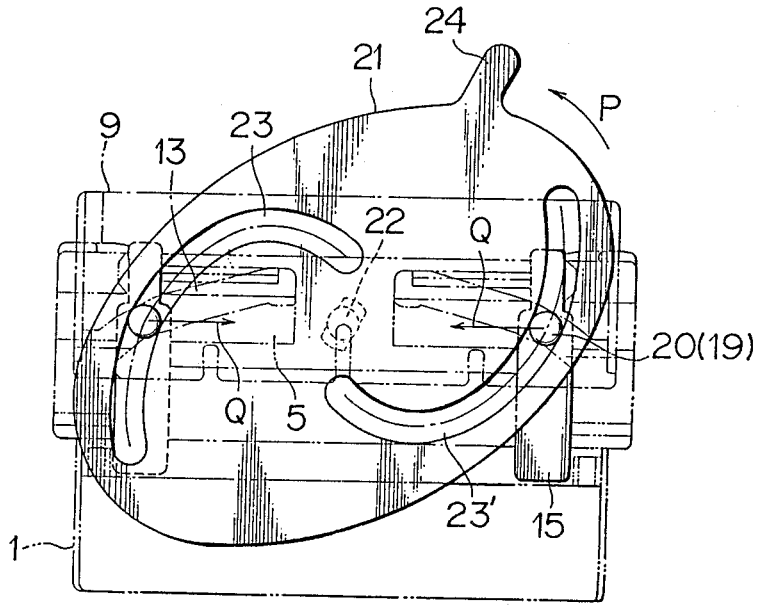

After the operation is completed, activate the plate 21 to rotate in the direction indicated by an arrow P as shown in FIG. 3 by pushing the projected handle 24 thereof so that both of the cam followers 19 are shifted to the center portion of the respective slots 5, in other words to the direction indicated by an arrow Q, along the guide grooves 23, 23', and also the male housing 9 is tracted into the female housing 1 by function of the cam tracks 13, 13' engaged with the respective cam followers 19, that is, the sliders 15 are shifted with a relatively small force by the lever action of the rotative operation board 21, whereby the both housings 1 and 9 are smoothly engaged.

Figure 4:
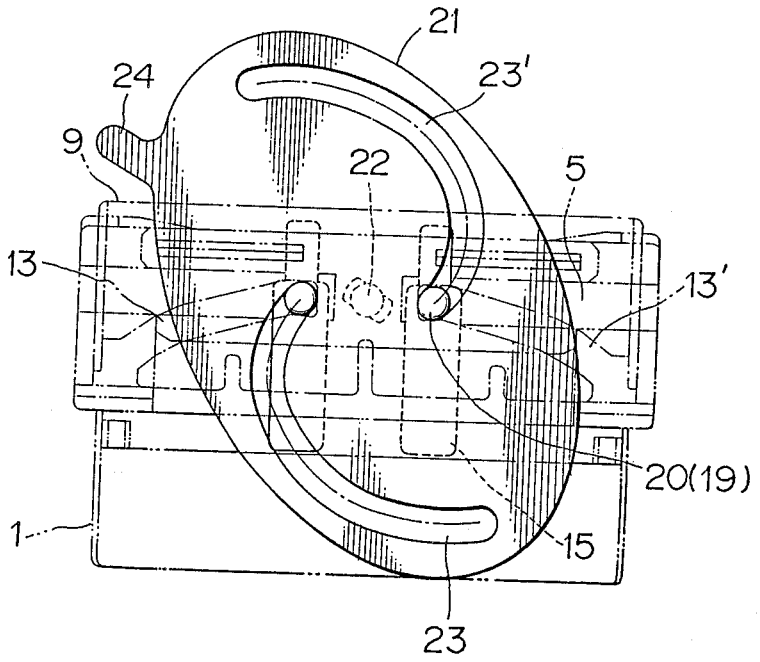
Figure 5A:
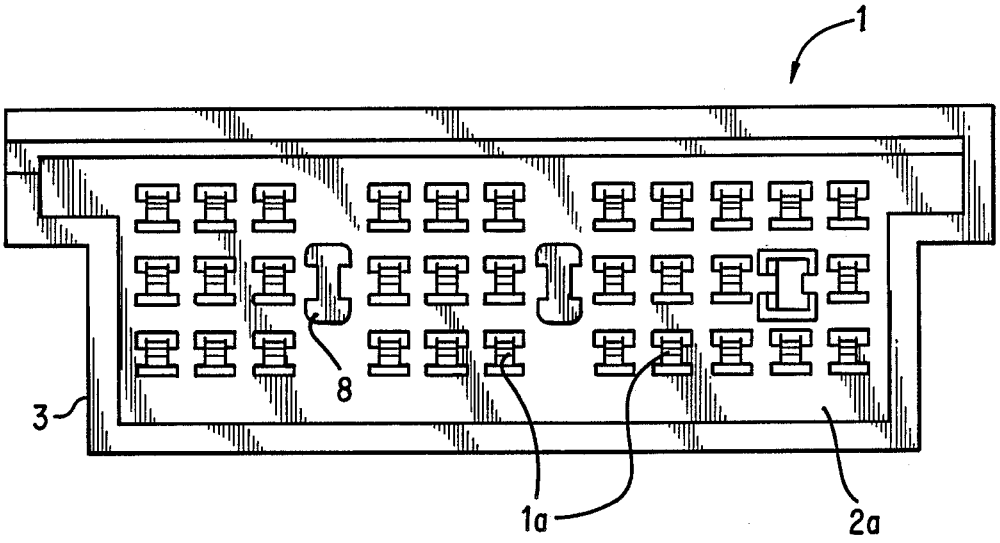
FIG. 5A is a front elevation of the female housing.
Figure 5B:
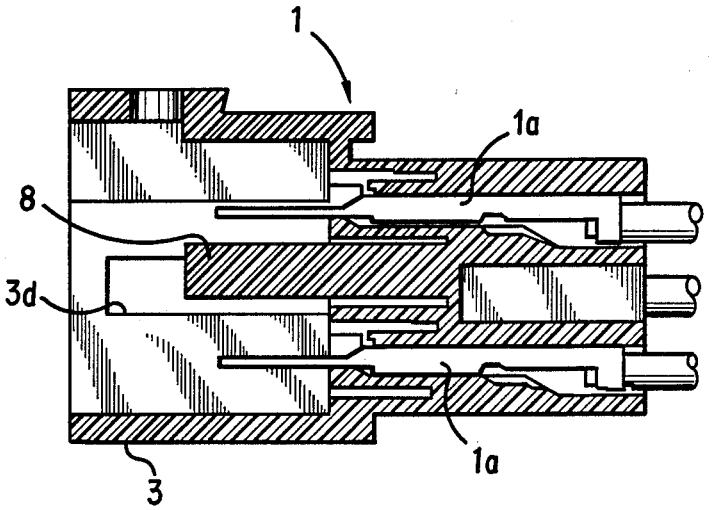
FIG. 5B is a section view of the female housing of FIG. 5A.
Figure 6A:
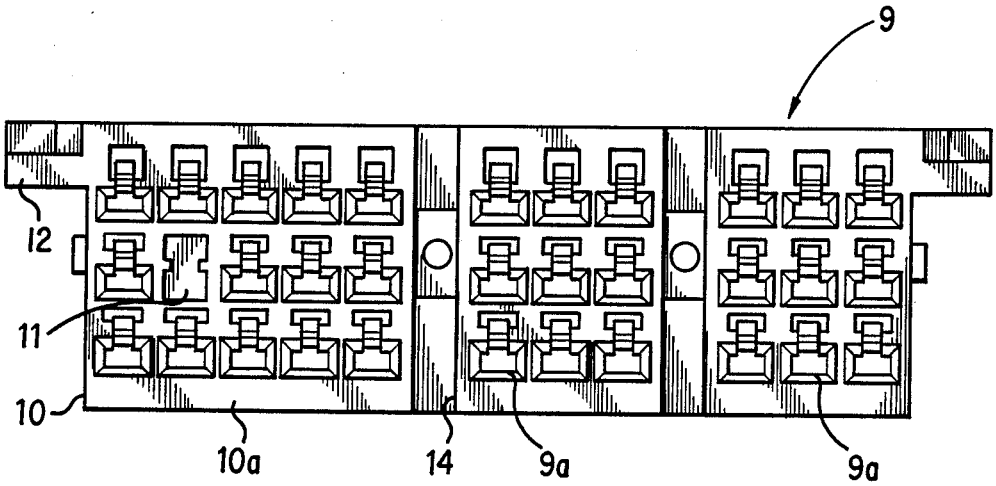
FIG. 6A is a front elevation of the male housing.
Figure 6B:
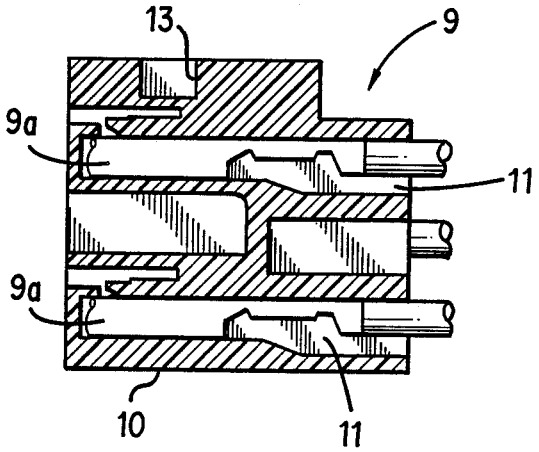
FIG. 6B is a sectional view of the male housing of FIG. 6A.
Figure 7:
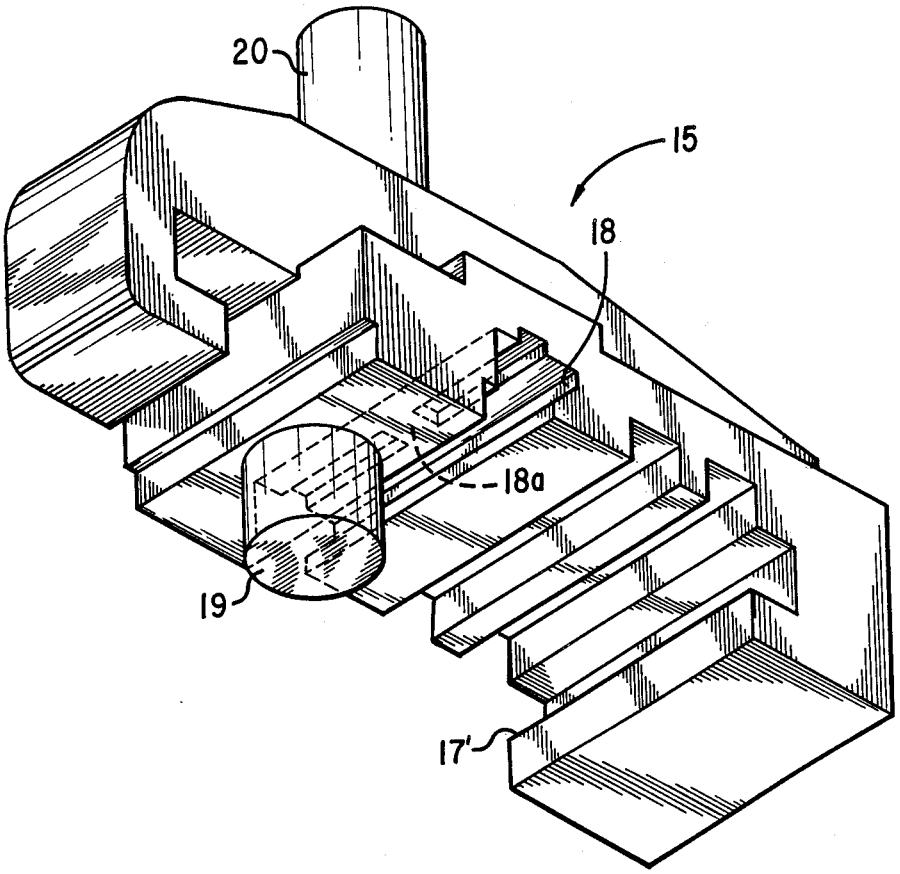
FIG. 7 is a perspective view showing the undersurface of a component of the connector shown in FIG. 1.

FIG. 4 shows the state in which the engagement conducted by the above operations is completed. Here, the cam followers 19 stop moving at the end of the respective slots 5 (closed location), thereby the engaging surfaces 2a and 10a of the respective housings are contacted so that the male and female terminals are connected to each other.

Removal of the housing 9 from housing 1 can be performed in the reverse order as shown in FIG. 4 to FIG. 2 by activating the rotary actuator plate 21 in the opposite direction to that shown by the arrow F.

By the way, when each of the sliders 15 is shifted between the open location and the closed location by activating the plate 21, there will be caused a force to remove the slider 15 from the enlarged body 3. In order to resist the above force, it will be much more effective to provide the above supporting rail 6 and supporting groove 18.

Since the pair of sliders 15 are symmetrically shifted against each other, the rotational moment to the male housing 9 caused by the cam followers 19 of the both sides are offset, whereby a smooth engagement and removal without ricketiness are performed.

Effect of the invention

As explained above, since each of the sliders provided with a cam mechanism is premounted in the female housing in the low force requiring multi-terminal connector according to the present invention, a manual switching operation of the two housings can be easily performed even in a limited narrow space.

Furthermore, the location shifting of the sliders for engagement and removal of the two housings can be performed with a relatively small force by lever function of the rotative operation board, and specially for the removing operation, only the space for inserting the rotative operation board is required, whereby the removing operation can be done even by one hand so that maintenance and replacement of the connector are also greatly facilitated.

What is claimed is:

1. A multi-terminal connector comprising:

a female housing having a plurality of male terminals stored therein;

a male housing having a plurality of female terminals stored therein;

a plurality of guide rails, at least two of which are connected to each other by a connecting portion provided with an axis hole at a center portion thereof on a longer side edge wall of an enlarged body portion of said female housing, said guide rails intersecting at right angles to the axes of said male terminals;

a pair of sliders with each slider slidably engageable with said guide rails and having a pin projecting upwardly from a top surface and a cam follower projecting downwardly from a lower portion thereof;

a pair of longitudinally aligned slots formed between said at least two guide rails with said connected center portion for permitting each of said cam followers to extend therethrough;

a pair of cam tracks arranged in an outer surface of said male housing and symmetrically extending rearward in a diagonal direction from the lateral ends thereof to receive said respective cam followers extending through said slots; and a rotary actuator plate provided with two symmetrical grooves provided around a pin projecting downwardly from a center portion thereof and adapted to be attached to said rail connecting portion by insertion of said pin through said axis hole.

2. A multi-terminal connector as claimed in claim 1, wherein said rotary actuator plate includes a pair of involutedly arcuated pin guide grooves which are symmetrically formed around said axis hole so as to be engaged with said upwardly projecting pins of said sliders.

3. A multi-terminal connector as claimed in claim 1, wherein said cam tracks comprise symmetrical entrances respectively for receiving said cam followers.

4. A multi-terminal connector as claimed in claim 3, wherein said rotary actuator plate further comprises a projected handle protruding from a corner of said rotary actuator plate itself.

5. A multi-terminal connector as claimed in claim 4, wherein said female housing further comprises an engaging surface and a plurality of guide shafts project outwardly from the engaging surface thereof.

6. A multi-terminal connector as claimed in claim 5, wherein said male housing further comprises a plurality of corresponding grooves to be engaged with said guide shafts.

7. A multi-terminal connector as claimed in claim 6, wherein one of said guide rails further includes a pair of catching nails at each end of an upper surface thereof.

8. A multi-terminal connector as claimed in claim 7, wherein each slider further comprises a catching projection adapted to be engaged between said catching nails at one end of said guide rail.

* * * * *